US010494066B1

(12) United States Patent
Garcia

(10) Patent No.: US 10,494,066 B1
(45) Date of Patent: Dec. 3, 2019

(54) ERGONOMIC PADDLE BOARD SYSTEM

(71) Applicant: Stephen Garcia, Crestline, CA (US)

(72) Inventor: Stephen Garcia, Crestline, CA (US)

( * ) Notice: Subject to any disclaimer, the term of this patent is extended or adjusted under 35 U.S.C. 154(b) by 0 days.

(21) Appl. No.: 16/120,753

(22) Filed: Sep. 4, 2018

(51) Int. Cl.
*B63B 35/71* (2006.01)
*B63B 29/04* (2006.01)

(52) U.S. Cl.
CPC ..... *B63B 35/71* (2013.01); *B63B 29/04* (2013.01); *B63B 2029/043* (2013.01); *B63B 2035/715* (2013.01)

(58) Field of Classification Search
CPC ..... B63B 35/71; B63B 35/79; B63B 29/04; B63B 2029/043; B63B 2035/715
See application file for complete search history.

(56) References Cited

U.S. PATENT DOCUMENTS 4,589,699 A 5/1986 Dungan
4,752,261 A * 6/1988 Rosello Zoya ..... B63B 35/795 114/363
4,843,999 A * 7/1989 Kobus ..... B63B 29/04 114/363
5,651,706 A * 7/1997 Kasper ..... B63B 7/082 114/354
7,086,702 B1 8/2006 Hurt
8,590,478 B2 11/2013 Lipman
9,643,696 B1 * 5/2017 Lockhart ..... B63B 35/85
2012/0077396 A1 * 3/2012 Lipman ..... B63B 35/71 441/74
2013/0189885 A1 * 7/2013 Wood ..... B63B 29/04 441/74
2015/0059638 A1 3/2015 Bishop
2018/0334227 A1 * 11/2018 Mellina ..... B63B 35/74

* cited by examiner

*Primary Examiner* — Anthony D Wiest
(74) *Attorney, Agent, or Firm* — Charles Runyan

(57) ABSTRACT

An ergonomic paddle board system including a paddleboard having a kneeling seat including a first-post, a second-post, a series of slots, a collapsible frame, a shin pad, and a seat pad. The kneeling seat is integral to the paddleboard and configured to fully collapse and extend for various uses. The ergonomic paddle board system provides a multi-positional seating configuration for a top surface of the paddleboard.

20 Claims, 5 Drawing Sheets

ERGONOMIC PADDLE BOARD SYSTEM

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

1. Field of the Invention

The present invention relates generally to the field of paddleboards and more specifically relates to a kneeling paddleboard.

2. Description of Related Art

Many people enjoy paddleboarding. Typically, paddleboards are propelled by a swimming motion using a person's arms while lying, kneeling, or standing on a paddleboard or surfboard in the ocean, using a paddle. Paddleboarding may also be done on various pieces of equipment, including surfboards. Paddleboards may be made of wood, fiberglass, epoxy, and/or carbon fiber and are generally quite large.

Paddleboarding takes an extensive amount of effort in order to paddle long distances and for long durations. People may get tired of standing or kneeling, and if the user decides to lay down on the board, visibility is lost. There are currently chairs capable of being mounted to boards; however, sitting and paddling are poor for posture and spinal support. Loss of endurance and comfort may lead to individuals paddle boarding for a short amount of time. A suitable solution is desired.

U.S. Pat. No. 8,752,492 to David R. Harris relates to a paddle board with removable seat. The described paddle board with removable seat includes a twin-hull paddle board for use while standing or sitting down, the twin-hull paddle board consists of two elongated hulls, a flat platform portion having two side edges, a front edge and a back edge, the platform portion connected across the top of the two hulls intermediate between the front ends and the back ends of each hull, the flat platform portion and the tops of the hulls forming an upper deck portion, the upper deck portion comprising two recessed foot wells placed adjacent to the side edges of the flat platform portion, the recessed foot wells contoured to prevent accumulation or puddling of water during use, and a coupling mechanism for removably coupling the leg portion of the removable seat to the upper deck portion of the paddle board.

BRIEF SUMMARY OF THE INVENTION

In view of the foregoing disadvantages inherent in the known paddleboard art, the present disclosure provides a novel ergonomic paddle board system. The general purpose of the present disclosure, which will be described subsequently in greater detail, is to provide a modified paddleboard with a built-in kneeling seat.

An ergonomic paddle board system is disclosed herein. The ergonomic paddle board system includes a paddleboard having a kneeling seat including a first-post, a second-post, a series of slots, a collapsible frame, a shin pad, and a seat pad. The kneeling seat is defined by the first-post, the second-post, the series of slots, the collapsible frame, the shin pad, and the seat pad configured within a housing.

The housing is preferably integral to the paddleboard. The kneeling seat is collapsible. The collapsible frame includes an x-frame-member and pivots at an axle of the x-frame-member. The shin pad and the seat pad are fixed to opposing respective portions of the x-frame-member. The first-post and the second-post are positioned at a base of the collapsible frame, the first-post being fixed to the housing and the second-post being relocatable within the series of slots. The first-post is rotatable within an aperture of the housing. The series of slots are configured to receive the second-post at a plurality of positions. The shin pad is proximal to a front-end of the paddleboard and configured to support a forward portion of a shin of a user thereon. The seat pad is proximal to a rear-end of the paddleboard and configured to support a posterior of the user thereon. The ergonomic paddle board system provides a multi-positional seating configuration for a top surface of the paddleboard.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, an ergonomic paddle board system, constructed and operative according to the teachings of the present disclosure.

The various embodiments of the present invention will hereinafter be described in conjunction with the appended drawings, wherein like designations denote like elements.

DETAILED DESCRIPTION

As discussed above, embodiments of the present disclosure relate to a paddleboard and more particularly to an ergonomic paddle board system as used to improve efficiency of paddleboarding.

Generally, the present invention provides users with an ergonomic paddle board with a folding kneeling chair built directly into the top of the board. It allows the seat to be removed and attached as desired to a mounting tray on the board. It improves posture and can reduce stress on the back, buttocks, and knees of an individual while using the paddle board. The present invention offers a way for individuals to paddle board for long distances and/or durations. Ergonomic paddle board system is a modified paddleboard with a built-in kneeling seat. The seat can be attached and removed to the board as desired. The paddleboard can include a mounting tray which receives the seat or a pole mounting for a permanent seat design. The seat can feature a sitting and a kneeling surface. Users can install the seat securely into the mounting tray or pole, which can also be installed to existing boards as well. Users can simply sit in the kneeling seat and paddle. The chair is intended to improve posture while reducing stress on the rear and lower portions of the body.

Ergonomic paddle board system can be constructed using wood, fiberglass, and other suitable materials. Foam and vinyl may be used to cover the chair surface. The device may measure approximately 24" in total length and 15" in total width. The tray may measure approximately 36" in length and 24" in width in order for the device to be retrofitted to existing boards. Exact size, measurement, construction, and design specifications may vary upon manufacturing.

Figure 1:
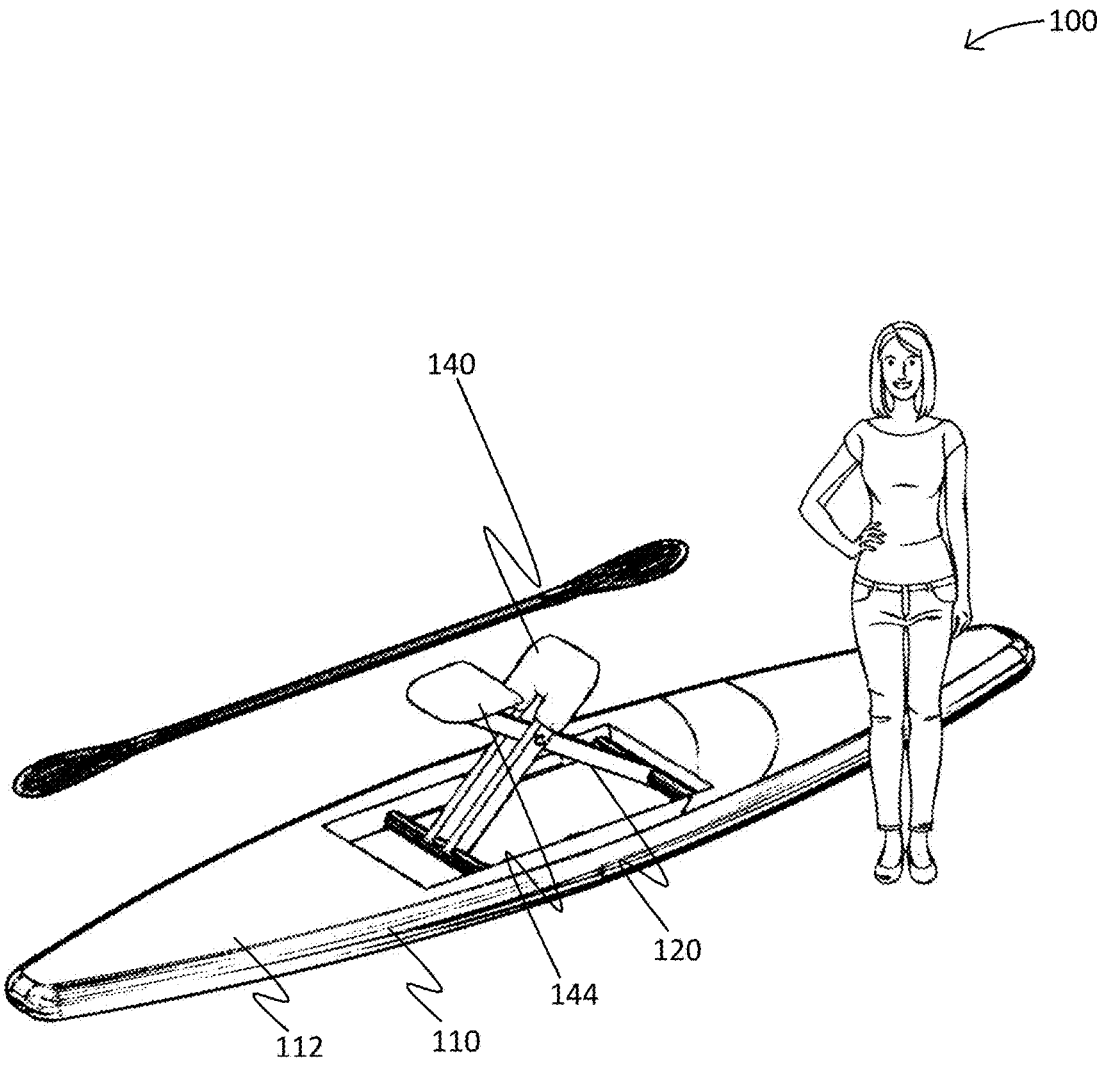
FIG. 1 is a perspective view of the ergonomic paddle board system during an 'in-use' condition, according to an embodiment of the disclosure.

Referring now more specifically to the drawings by numerals of reference, there is shown in FIGS. 1-5, various views of an ergonomic paddle board system 100. FIG. 1 shows an ergonomic paddle board system 100 during an 'in-use' condition 150, according to an embodiment of the present disclosure. As illustrated, the ergonomic paddle board system 100 may include a paddleboard 110 having a kneeling seat 120 including a first-post 122, a second-post 128, a series of slots 132, a collapsible frame 136, a shin pad 140, and a seat pad 144. The kneeling seat 120 is defined by the first-post 122, the second-post 128, the series of slots 132, the collapsible frame 136, the shin pad 140, and the seat pad 144 configured within a housing 160. The housing 160 being integral to the paddleboard 110. The kneeling seat 120 is collapsible. The collapsible frame 120 includes an x-frame-member 164 and pivots at an axle of the x-frame-member 164. The shin pad 140 and the seat pad 144 are fixed to opposing respective portions of the x-frame-member 164. The first-post 122 and the second-post 128 are positioned at a base of the collapsible frame 136; the first-post 122 being fixed to the housing 160 and the second-post 128 being relocatable within the series of slots 132. The ergonomic paddle board system 100 provides a multi-positional seating configuration for a top surface 112 of the paddleboard 110.

Figure 2:
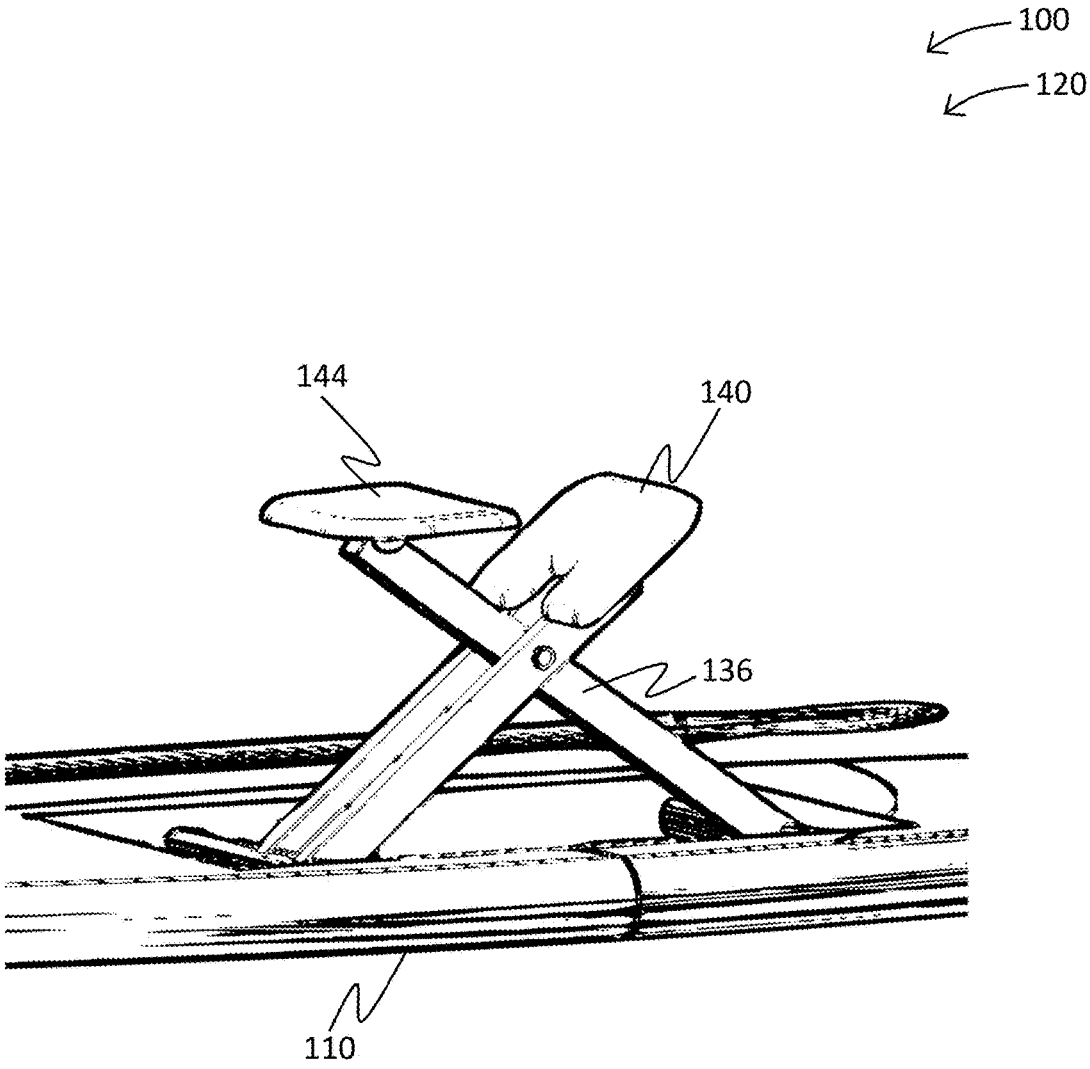
FIG. 2 is a perspective view of the ergonomic paddle board system of FIG. 1, according to an embodiment of the present disclosure.

FIG. 2 shows a perspective view of the ergonomic paddle board system 100 of FIG. 1, according to an embodiment of the present disclosure. As above, the ergonomic paddle board system 100 may include the paddleboard 110 having the integral kneeling seat 120 providing ergonomic support for a user. The integral kneeling seat 120 includes the first-post 122, the second-post 128, the series of slots 132, the collapsible frame 136, the shin pad 140, and the seat pad 144. The first-post 122 is rotatable within an aperture of the housing 160. The first-post 122 comprises a greater length than the second-post 128. The first-post 122 and the second-post 128 are parallel to each other. An angle of the x-frame-member 164 and a height of the kneeling seat 120 is adjustable. The series of slots 132 are configured to receive the second-post 128 at a plurality of positions.

Figure 3:
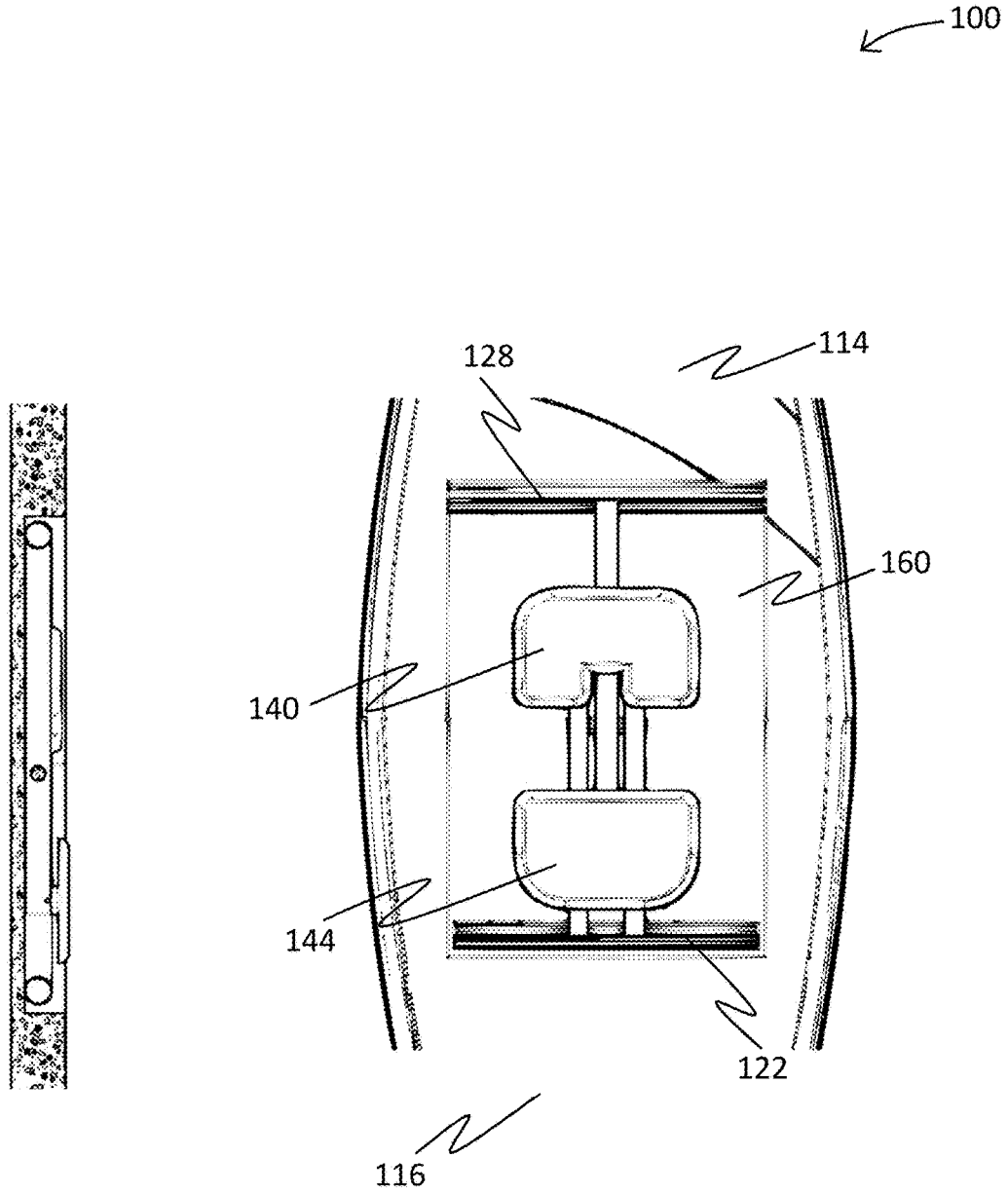
FIG. 3 is a perspective view of the ergonomic paddle board system of FIG. 1, according to an embodiment of the present disclosure.

Referring now to FIG. 3 showing a perspective view of the ergonomic paddle board system 100 of FIG. 1, according to an embodiment of the present disclosure. As above, the ergonomic paddle board system 100 may include the paddleboard 110 having the kneeling seat 120 including the first-post 122, the second-post 128, the series of slots 132, the collapsible frame 136, the shin pad 140, and the seat pad 144. The shin pad 140 is proximal to a front-end 114 of the paddleboard 110 and configured to support a forward portion of a shin of a user thereon. The seat pad 144 is proximal to a rear-end 116 of the paddleboard 110 and configured to support a posterior of the user thereon. The shin pad 140 and the seat pad are 144 preferably comprised of foam. The present invention provides users with an ergonomic paddle board system 100 with a kneeling seat 120 built directly into the top of the paddleboard 110. It allows the kneeling seat 120 to be raised or lowered as desired within the top of the paddleboard 110. It improves posture and can reduce stress on the back, buttocks, and knees of an individual while using the paddle board 110.

Figure 4:
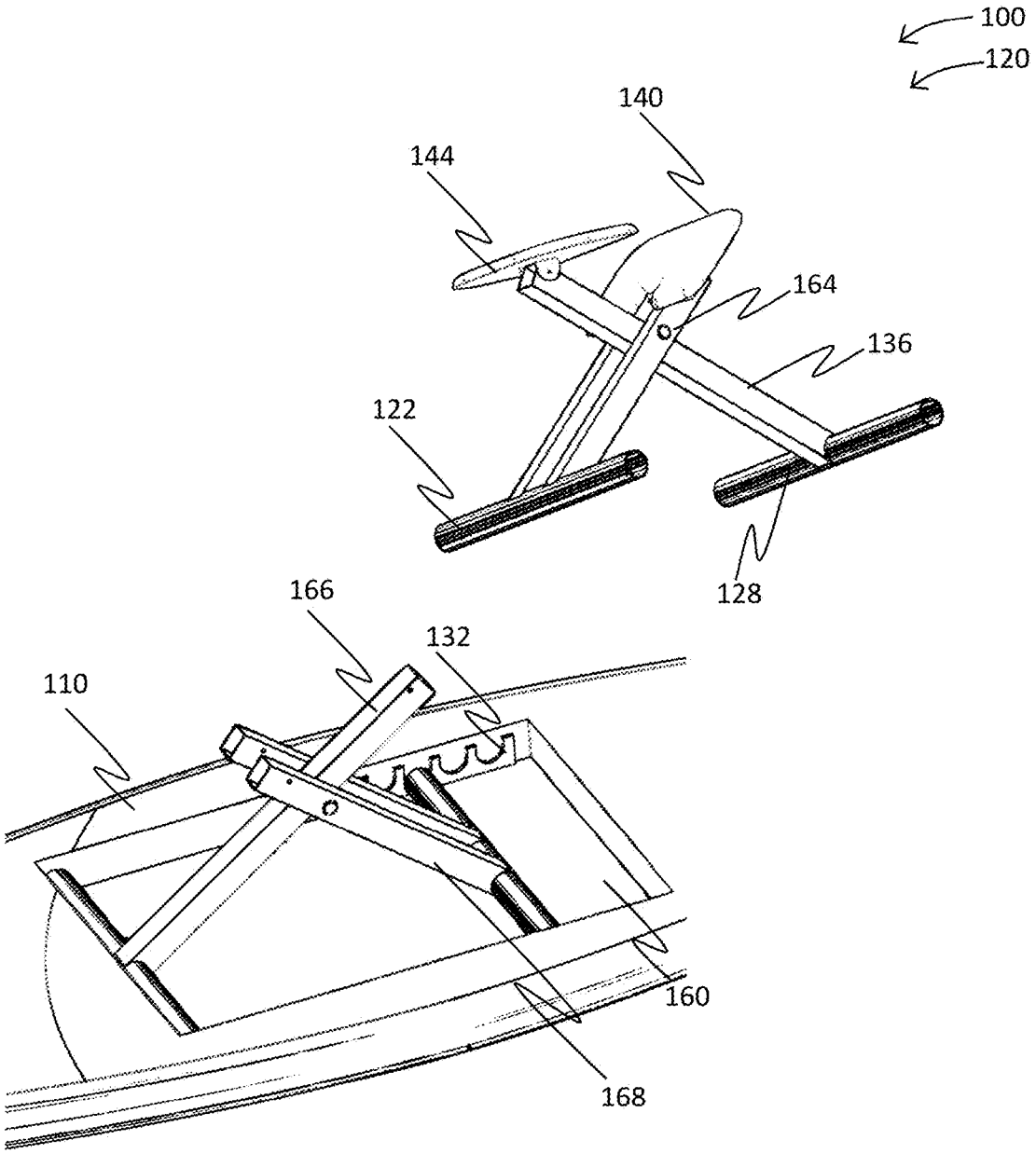
FIG. 4 is a perspective view of the ergonomic paddle board system of FIG. 1, according to an embodiment of the present disclosure.

FIG. 4 shows a perspective view of the ergonomic paddle board system 100 of FIG. 1, according to an embodiment of the present disclosure. As above, the ergonomic paddle board system 100 may include the paddleboard 110 having the kneeling seat 120 including the first-post 122, the second-post 128, the series of slots 132, the collapsible frame 136, the shin pad 140, and the seat pad 144. The seat pad 144 is parallel to the top surface 112 of the paddleboard 110. The shin pad 140 is configured at an angle relative to the top surface 112 of the paddleboard 110 during an extended in-use condition. The housing 160 comprises a rectangular profile having an inner volume. The inner volume comprises a depth suitable for receiving the kneeling seat 120 in a collapsed position, the kneeling seat 120 being flush with the top surface 112 of the paddleboard 110 during the collapsed position. The housing 160 comprises a length of approximately 36 inches and a width of approximately 24 inches.

Figure 5:
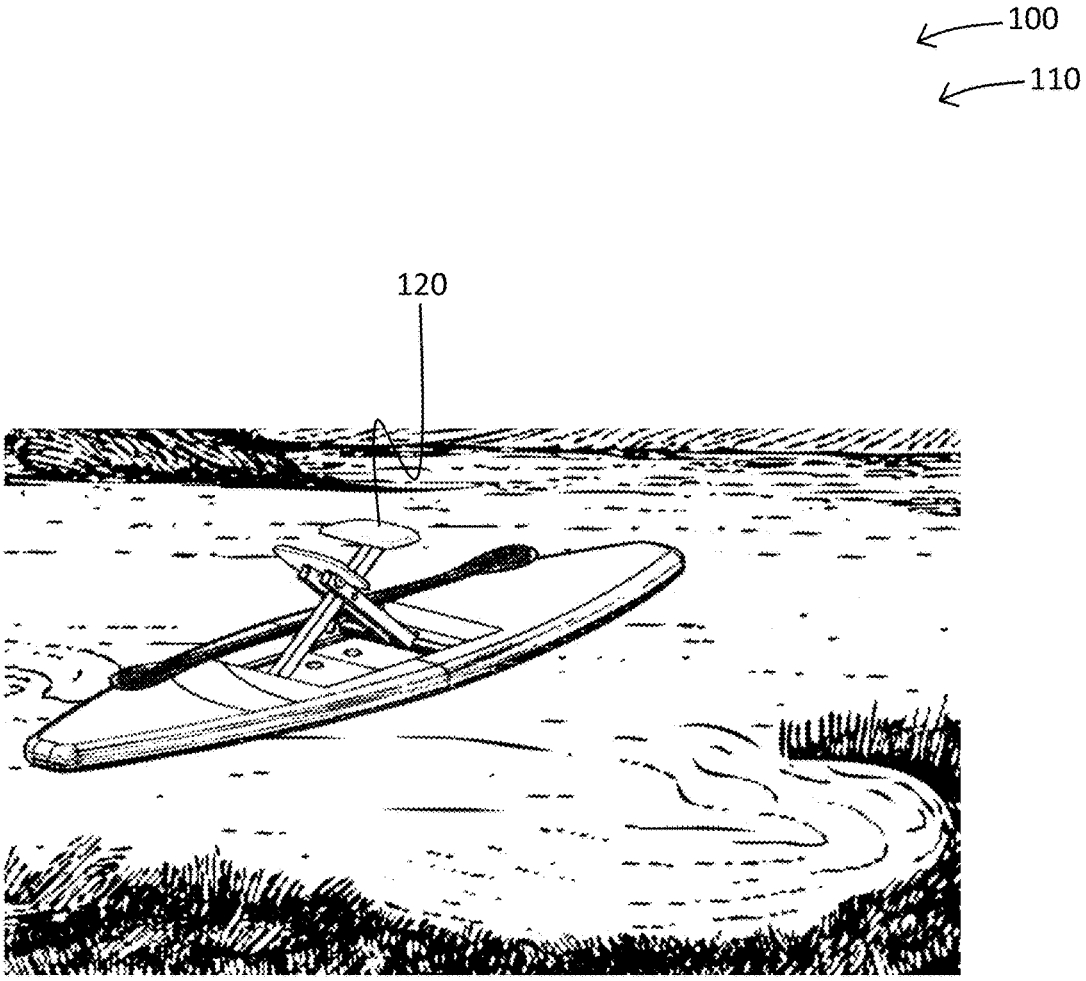
FIG. 5 is a perspective view of the ergonomic paddle board system of FIG. 1, according to an embodiment of the present disclosure.

Referring now to FIG. 5 showing a perspective view of the ergonomic paddle board system 100 of FIG. 1, according to an embodiment of the present disclosure. As above, the ergonomic paddle board system 100 may include the paddleboard 110 having the kneeling seat 120 including the first-post 122, the second-post 128, the series of slots 132, the collapsible frame 136, the shin pad 140, and the seat pad 144. The collapsible frame 136 includes a first-member 166 supporting the shin pad 140 and a second-member 168 supporting the seat pad 144. The first-member 166 comprises a shorter length than the second-member 168. The kneeling seat 120 may be retrofit to a pre-exiting paddleboard 110 using necessary hardware and fasteners or pre-installed to the paddleboard 110. The collapsible frame 136 is rigid and configured to support a weight of the user thereon. The present invention offers a way for individuals to paddleboard for long distances and/or durations.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. An ergonomic paddle board system comprising:
a paddleboard having;
a kneeling seat including;
a first-post;
a second-post;
a series of slots;
a collapsible frame;
a shin pad; and
a seat pad;
wherein said kneeling seat is defined by said first-post, said second-post, said series of slots, said collapsible frame, said shin pad, and said seat pad configured within a housing, said housing being integral to said paddleboard;
wherein said kneeling seat is collapsible, said collapsible frame includes an x-frame-member and pivots at an axle of said x-frame-member;
wherein said shin pad and said seat pad are fixed to opposing respective portions of said x-frame-member;
wherein said first-post and said second-post are positioned at a base of said collapsible frame, said first-post being relocatable within said series of slots and said second-post being fixed to said housing; and
wherein said ergonomic paddle board system provides a multi-positional seating configuration for a top surface of said paddleboard.

2. The ergonomic paddle board system of claim 1, wherein said second-post is rotatable within an aperture of said housing.

3. The ergonomic paddle board system of claim 2, wherein said second-post comprises a greater length than said first-post.

4. The ergonomic paddle board system of claim 3, wherein said first-post and said second-post are parallel to each other.

5. The ergonomic paddle board system of claim 1, wherein an angle of said x-frame-member and a height of said kneeling seat is adjustable.

6. The ergonomic paddle board system of claim 5, wherein said series of slots are configured to receive said first-post at a plurality of positions.

7. The ergonomic paddle board system of claim 1, wherein said shin pad is proximal to a front-end of said paddleboard and configured to support a forward portion of a shin of a user thereon.

8. The ergonomic paddle board system of claim 7, wherein said seat pad is proximal to a rear-end of said paddleboard and configured to support a posterior of said user thereon.

9. The ergonomic paddle board system of claim 7, wherein said collapsible frame is rigid and configured to support a weight of said user thereon.

10. The ergonomic paddle board system of claim 1, wherein said shin pad and said seat pad comprise foam.

11. The ergonomic paddle board system of claim 1, wherein said seat pad is parallel to said top surface of said paddleboard.

12. The ergonomic paddle board system of claim 11, wherein said shin pad is configured at an angle relative to said top surface of said paddleboard during an extended in-use condition.

13. The ergonomic paddle board system of claim 1, wherein said housing comprises a rectangular profile having an inner volume.

14. The ergonomic paddle board system of claim 13, wherein said inner volume comprises a depth suitable for receiving said kneeling seat in a collapsed position, said kneeling seat being flush with said top surface of said paddleboard during said collapsed position.

15. The ergonomic paddle board system of claim 13, wherein said housing comprises a length of approximately 36 inches and a width of approximately 24 inches.

16. The ergonomic paddle board system of claim 1, wherein said collapsible frame includes a first-member supporting said seat pad and a second-member supporting said shin pad.

17. The ergonomic paddle board system of claim 16, wherein said first-member comprises a greater length than said second-member.

18. The ergonomic paddle board system of claim 1, wherein said kneeling seat is retrofit to a pre-existing said paddleboard.

19. The ergonomic paddle board system of claim 1, wherein said kneeling seat is pre-installed.

20. An ergonomic paddle board system, the ergonomic paddle board system comprising:
a paddleboard having;
a kneeling seat including;
a first-post;
a second-post;
a series of slots;
a collapsible frame;
a shin pad; and
a seat pad;
wherein said kneeling seat is defined by said first-post, said second-post, said series of slots, said collapsible frame, said shin pad, and said seat pad configured within a housing, said housing being integral to said paddleboard;
wherein said kneeling seat is collapsible, said collapsible frame includes an x-frame-member and pivots at an axle of said x-frame-member;
wherein said shin pad and said seat pad are fixed to opposing respective portions of said x-frame-member;
wherein said first-post and said second-post are positioned at a base of said collapsible frame, said first-post being relocatable within said series of slots and said second-post being fixed to said housing;
wherein said ergonomic paddle board system provides a multi-positional seating configuration for a top surface of said paddleboard;
wherein said second-post is rotatable within an aperture of said housing;
wherein said second-post comprises a greater length than said first-post;
wherein said first-post and said second-post are parallel to each other;
wherein an angle of said x-frame-member and a height of said kneeling seat is adjustable;
wherein said series of slots are configured to receive said first-post at a plurality of positions;
wherein said shin pad is proximal to a front-end of said paddleboard and configured to support a forward portion of a shin of a user thereon;
wherein said seat pad is proximal to a rear-end of said paddleboard and configured to support a posterior of said user thereon;
wherein said shin pad and said seat pad comprise foam;
wherein said seat pad is parallel to said top surface of said paddleboard;
wherein said shin pad is configured at an angle relative to said top surface of said paddleboard during an extended in-use condition;

wherein said housing comprises a rectangular profile having an inner volume;

wherein said inner volume comprises a depth suitable for receiving said kneeling seat in a collapsed position, said kneeling seat being flush with said top surface of said paddleboard during said collapsed position;

wherein said housing comprises a length of approximately 36 inches and a width of approximately 24 inches;

wherein said collapsible frame includes a first-member supporting said seat pad and a second-member supporting said shin pad;

wherein said first-member comprises a greater length than said second-member;

wherein said kneeling seat is pre-installed; and wherein said collapsible frame is rigid and configured to support a weight of said user thereon.

* * * * *